US006849008B1

(12) United States Patent
Wang

(10) Patent No.: US 6,849,008 B1
(45) Date of Patent: Feb. 1, 2005

(54) GOLF TEE

(76) Inventor: Austin Wang, 3F-1, No. 215, Cheng-Teh Road, Sec. 2, Taipei (TW)

( * ) Notice: Subject to any disclaimer, the term of this patent is extended or adjusted under 35 U.S.C. 154(b) by 0 days.

(21) Appl. No.: 10/656,632

(22) Filed: Sep. 3, 2003

(51) Int. Cl.[7] ..... A63B 57/00
(52) U.S. Cl. ..... 473/401
(58) Field of Search ..... 473/386–403

(56) References Cited

U.S. PATENT DOCUMENTS 1,551,207 A * 8/1925 Nial et al. ..... 473/400
2,693,358 A * 11/1954 Dawson, Jr. ..... 473/398
4,516,780 A * 5/1985 Tabet ..... 473/398
5,085,431 A * 2/1992 McGuire ..... 473/386
6,110,060 A * 8/2000 Spoto ..... 473/396

* cited by examiner

*Primary Examiner*—Steven Wong

(57) ABSTRACT

A golf tee includes: a peg member inserted into the ground; and a flexible holding member engageably mounted on the peg member having a seat portion for holding a golf ball thereon, a coupling base for engaging the peg member therewith, and a plurality of links connected between the seat portion and the coupling base; whereby upon driving of the golf ball off the seat portion as struck by a club head, the flexible holding member may be temporarily biased for absorbing the striking force partially acting upon the golf tee and then the flexible holding member will be restored upright automatically to thereby be repeatedly reusable.

3 Claims, 3 Drawing Sheets

GOLF TEE

BACKGROUND OF THE INVENTION

U.S. Pat. No. 5,242,170 to Richard E. Ward disclosed a golf tee comprising a lower piece having a spike inserted into the ground, and an upper piece mounted on an upper portion of the lower piece having a retainer shaft (22) extending upwardly into the upper piece from the spike.

However such a prior art has the following drawbacks:

1. The sleeve (26) of the upper piece should be made of flexible material, which however may be bent, twisted or deformed once loaded with a golf ball thereon to thereby influence the supporting stability and the flying orientation of the ball when struck by a club head.
2. The retainer shaft (22) is integrally formed with the ground spike (14) which is made with rigid material. So, the shaft (22) may be easily broken to thereby shorten its life cycles. Or, once being bent and deformed, it is difficult to be restored and therefore unsuitable to be reused.

The present inventor has found the drawbacks of the conventional golf tee and invented the present reusable golf tee for stably supporting the golf ball.

SUMMARY OF THE INVENTION

The object of the present invention is to provide a golf tee including: a peg member inserted into the ground; and a flexible holding member engageably mounted on the peg member having a seat portion for holding a golf ball thereon, a coupling base for engaging the peg member therewith, and a plurality of links connected between the seat portion and the coupling base; whereby upon driving of the golf ball off the seat portion as struck by a club head, the flexible holding member may be temporarily biased for absorbing the striking force partially acting upon the golf tee and then the flexible holding member will be restored upright automatically to thereby be repeatedly reusable.

DETAILED DESCRIPTION

Figure 1:
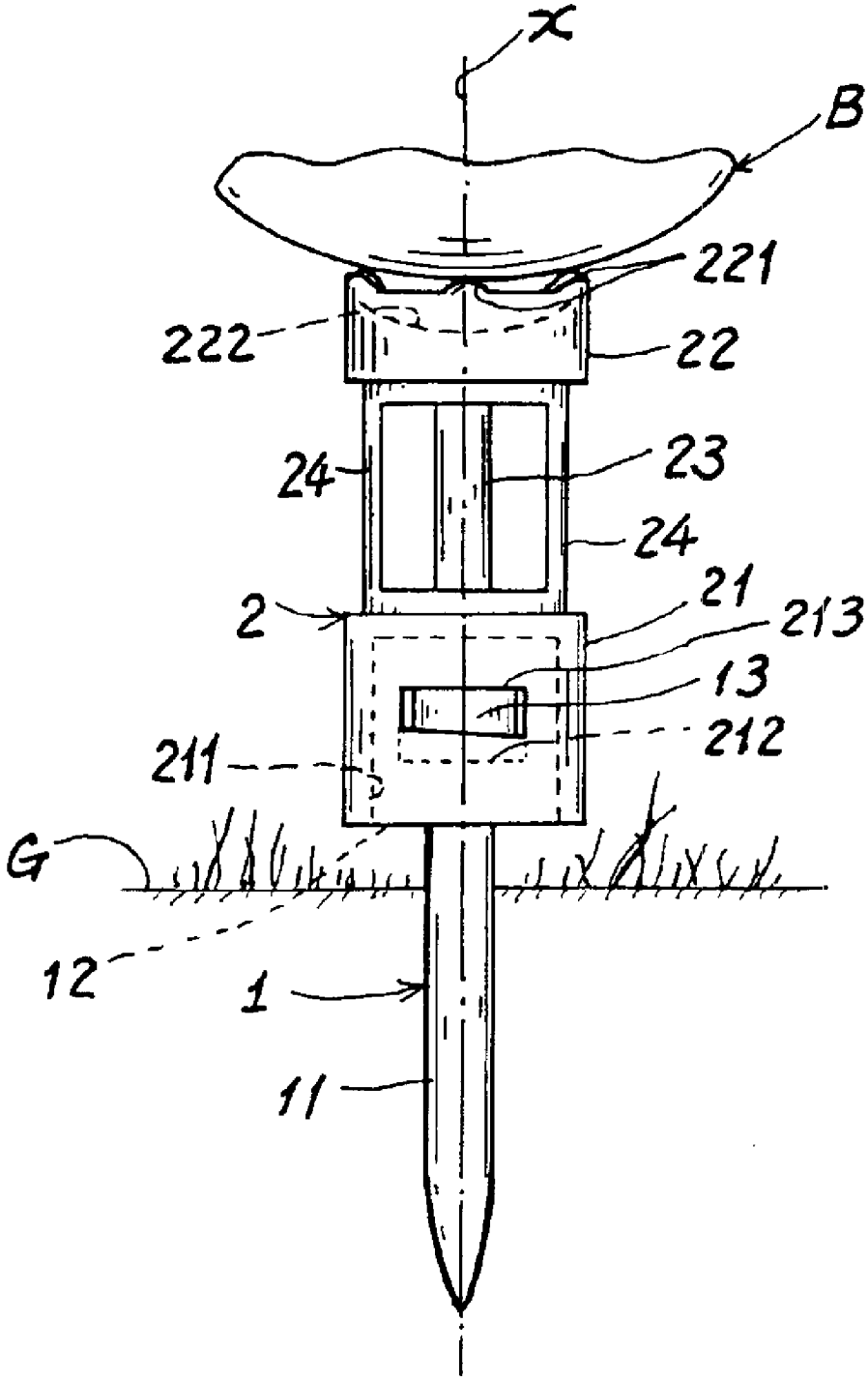
FIG. 1 is a front-view illustration of the present invention.
Figure 2:
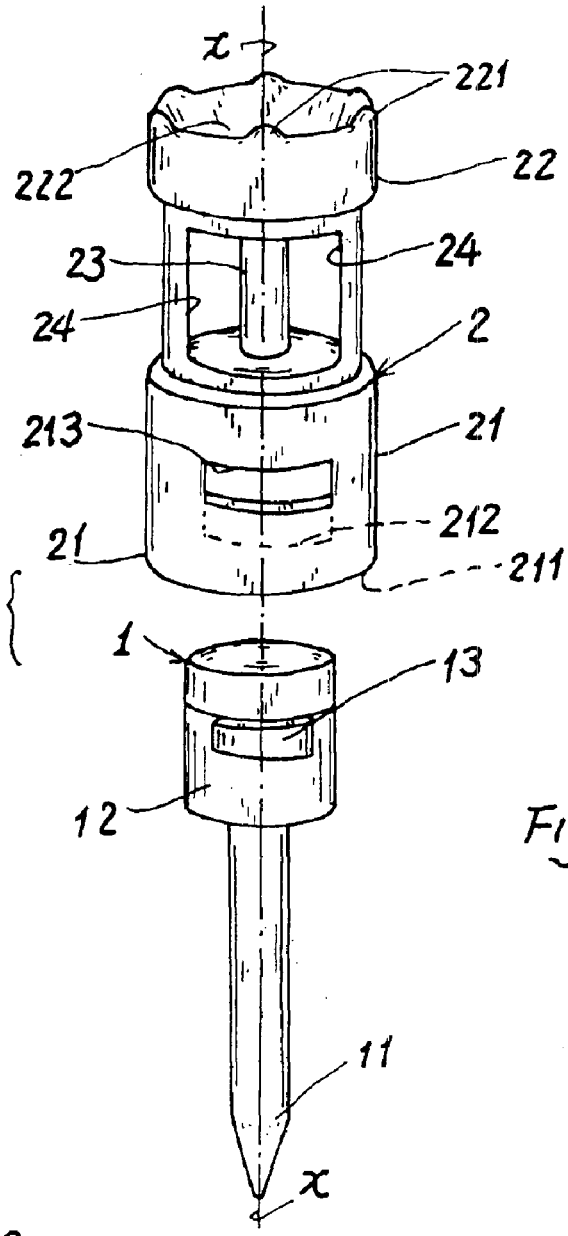
FIG. 2 is an illustration showing two pieces of the golf tee of the present invention.

As shown in the drawing figures, a golf tee of the present invention comprises: a peg member 1 inserted in the ground G; and a flexible holding member 2 engageably mounted on the peg member 1 for holding a golf ball B thereon. A longitudinal axis X is defined at a longitudinal center of the golf tee when coupling the holding member 2 with the peg member 1.

The peg member 1 includes: a peg 11 inserted in the ground, a head portion 12 formed on an upper portion of the peg 11, and a pair of lugs 13 circumferentially formed on the head portion 12 to be engaged with the flexible holding member 2.

Each lug 13 may be formed as a wedge or an angled block in order to be engageable with a corresponding counter-part (a slot) formed in the flexible holding member 2.

The peg member 1 is integrally formed by any plastic molding process and may be made of rigid plastic or composite materials to be firmly inserted into the ground.

The flexible holding member 2 is integrally formed with flexible resilient materials including elastomers, plastics, rubber and composite materials having proper elasticity (resilience) and flexibility. Upon acting of striking force against the flexible holding member 2 to bias the holding member 2, it should be restored upright automatically by its flexibility and resilience.

The flexible holding member 2 includes: a coupling base 21 engageable with the head portion 12 of the peg member 1; a seat portion 22 formed above the coupling base 21 for holding a golf ball thereon; an axial link 23 axially formed in a longitudinal center of the flexible holding member 2 about the longitudinal axis X, and connected between the seat portion 22 and the coupling base 21; and at least two (or plural) side links 24 circumferentially connected between the seat portion 22 and the coupling base 21 and disposed about the axial link 23.

The coupling base 21 includes a socket 211 recessed in a bottom portion of the base 21 for engaging the head portion 12 of the peg member 1 with the socket 211, a pair of retaining extensions 212 arcuately formed on an inside wall of the socket 211 about the longitudinal axis X for retaining the pair of lugs 13 formed on the peg member 1, a pair of slots 213 arcuately notched in the coupling base 21 about the longitudinal axis X for engageably locking the pair of lugs 13 formed on the peg member.

Figure 3:
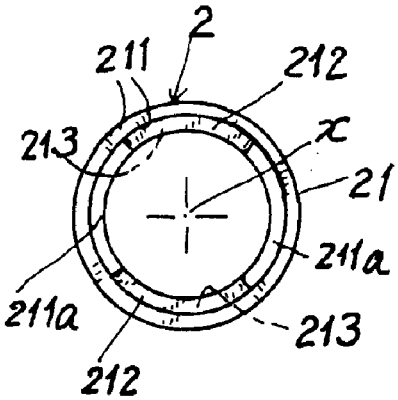
FIG. 3 is a bottom view of the flexible holding member of the golf tee.
Figure 4:
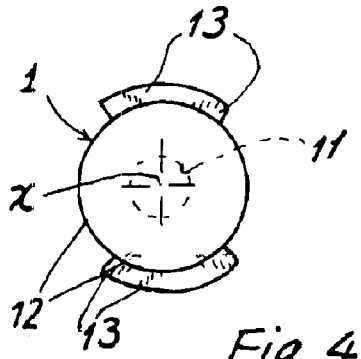
FIG. 4 is a top view of the peg member of the golf tee.

A pair of recesses 211*a* are oppositely formed in the inside wall of the socket 211 in order to pass the pair of lugs 13 on the peg member 1 (FIGS. 3, 4) when coupling the head portion 12 of the peg member 1 in the socket 211 of the base 21. Then the peg member 1 is rotated to engage the lugs 13 with the slots 213 formed in the base 21 and also to retain the lugs 13 on the retaining extensions 212 to thereby firmly "lock" the peg member 1 in the holding member 2 to serve as a golf tee as shown in FIG. 1 for teeing use. The lug 13 may be formed as a wedge shape, while the slot 213 may be correspondingly formed as wedge shape.

The seat portion 22 includes: a plurality of protrusions 221 circumferentially formed on a rim of a shallow cavity 222 spherically or conically recessed in a top portion of the seat portion 22 for supporting the golf ball B on the protrusions 221 with point-to-point contact, other than a full-surface contact, between the golf ball B and the seat portion 22 to have the following advantages:

1. Due to the point-to-point contact between the golf ball B and the protrusions 221 on the seat portion 22, the frictional force exerting therebetween will be minimized to minimally influence the striking and flying precision when driving the ball off the tee.
2. The striking force, when driving the golf ball, will be downwardly "transferred" from the ball to the golf tee of this invention, and will however be greatly minimized by the point contact of the protrusions 221, thereby biasing the upper holding member 2 with merely a slight deformation and thereby causing little damage to the tee.

Between the upper seat portion 22 and the lower base 21, there are a plurality of links 23, 24 provided for reliably connecting the seat portion 22 and the base 21.

The axial link 23 may be surrounded by two (or plural) side links 24 for stably supporting the ball B as loaded on the seat portion 22 of the golf tee. The links 23, 24 should have a compression strength durable for supporting the golf ball B without being bent, twisted or deformed.

Figure 5:
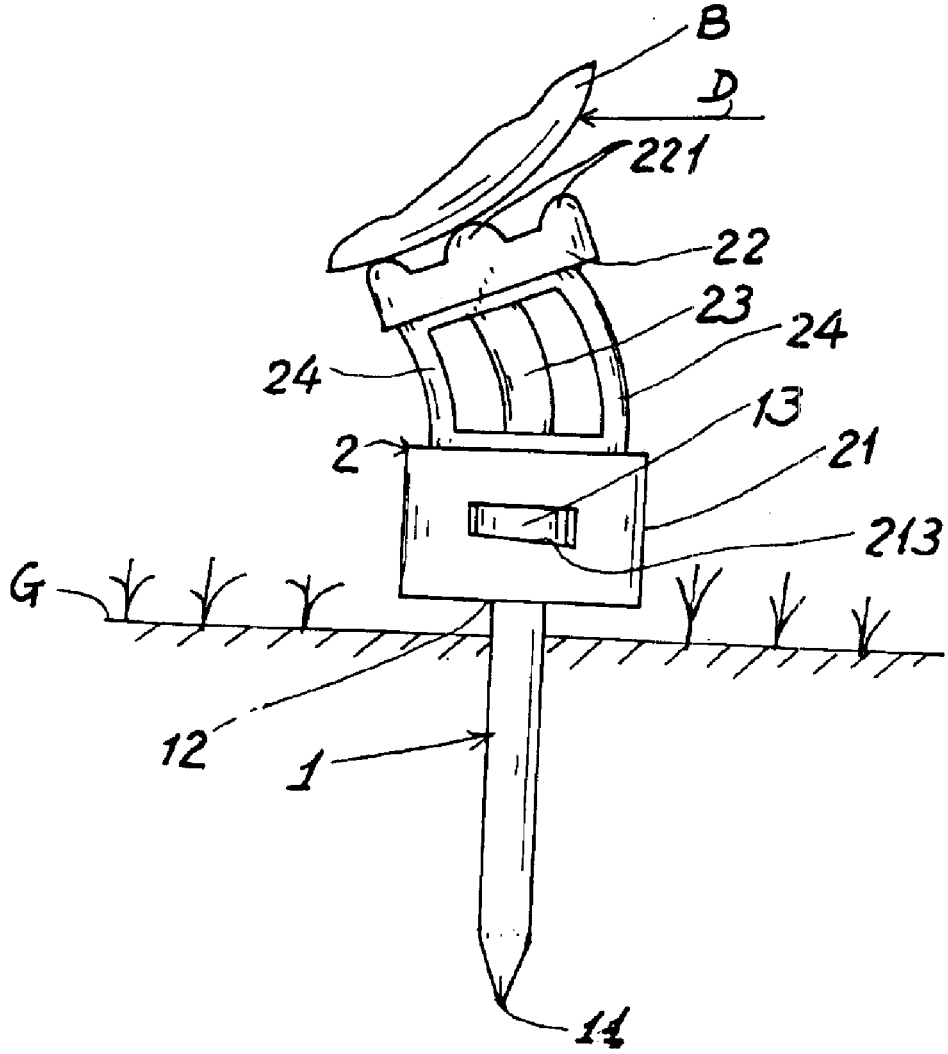
FIG. 5 is an illustration showing a bending golf tee when teeing off in accordance with the present invention.

When driving (D) the golf ball by a club head (not shown) as shown in FIG. 5, the ball is struck off the seat portion 22 of the tee and the seat portion 22 will be slightly biased due to the flexibility of the upper holding member 3. When the striking force is released, the upper holding member 2 will be restored upright automatically to be ready for next teeing use.

The present invention is superior to the conventional golf tees with the following advantages:

1. The flexible holding member 2 provides the plural links 23, 24 for connecting the upper seat portion 22 and the lower base 21 for stably durably supporting the ball B as loaded on the seat portion 22, without influencing the striking precision when teeing off.
2. The flexible holding member 2 renders flexibility and resilience so that the golf tee may be flexibly biased when teeing off and may then be automatically restored to be an upright position, thereby being repeatedly reusable.
3. Since the point contact of the protrusions 221 with the ball, the downwardly transferred striking force will be greatly dampened, being beneficial for prolonging the service life of the tee.
4. The striking force will also be dampened or buffered by the links 23, 24 connected between the seat portion 22 and the base 21 and by the whole holding member 2 as made of flexible materials, thereby reducing the force fraction downwardly transferred to the peg member 1 and thereby being uneasy to break the tee of the present invention.

The present invention may be modified without departing from the spirit and scope of the present invention.

I claim:

1. A golf tee comprising:

a peg member integrally formed with rigid materials and including a peg inserted into the ground, a head portion formed on an upper portion of said peg, and a pair of lugs circumferentially formed on the head portion; and a flexible holding member integrally formed with flexible resilient materials; having a longitudinal axis defined at a longitudinal center of said flexible holding member and said peg member when coupled together; said flexible holding member including: a coupling base engageable with said head portion of the peg member; a seat portion formed above the coupling base for holding said golf ball thereon; an axial link axially formed in said longitudinal center of the flexible holding member about the longitudinal axis, and connected between the seat portion and the coupling base; and at least two side links circumferentially connected between the seat portion and the coupling base and disposed about the axial link; said coupling base including a socket recessed in a bottom portion of the base for engaging the head portion of the peg member with the socket, a pair of retaining extensions arcuately formed on an inside wall of the socket about said longitudinal axis for retaining the pair of lugs formed on the peg member, a pair of slots arcuately notched in the coupling base about the longitudinal axis for engageably locking the pair of lugs formed on the peg member; whereby the peg member is rotated to engage the lugs on the pep member with the slots formed in the coupling base and to retain the lugs of the peg member on the retaining extensions of the coupling base to thereby firmly lock the peg member in the holding member to form a golf tee; and whereby upon driving of the golf ball off the seat portion of the holding member by a striking force as struck by a club head to slightly bias said holding member, said holding member will be restored upright automatically when releasing the striking force to allow the golf tee to be repeatedly reusable.

2. A golf tee according to claim 1, wherein said lug is formed as wedge shape, and said slot is correspondingly formed as wedge shape.

3. A golf tee according to claim 1, wherein said seat portion includes: a plurality of protrusions circumferentially formed on a rim of a shallow cavity spherically recessed in a top portion of the seat portion for supporting the golf ball on the protrusions with point-to-point contact between the golf ball and the protrusions of the seat portion.

* * * * *